US011462815B2

(12) United States Patent
Wu et al.

(10) Patent No.: US 11,462,815 B2
(45) Date of Patent: Oct. 4, 2022

(54) ELECTRONIC DEVICE AND ANTENNA MODULE

(71) Applicant: PEGATRON CORPORATION, Taipei (TW)

(72) Inventors: Chien-Yi Wu, Taipei (TW); Chao-Hsu Wu, Taipei (TW); Cheng-Hsiung Wu, Taipei (TW); Ching-Hsiang Ko, Taipei (TW); Shih-Keng Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 17/371,643

(22) Filed: Jul. 9, 2021

(65) Prior Publication Data

US 2022/0094034 A1 Mar. 24, 2022

(30) Foreign Application Priority Data

Sep. 21, 2020 (TW) ..... 109132589

(51) Int. Cl.

| | |
|---|---|
| ***H01Q 1/20*** | (2006.01) |
| ***H01Q 1/24*** | (2006.01) |
| ***H01Q 1/50*** | (2006.01) |
| ***H01Q 1/10*** | (2006.01) |
| ***H01Q 21/28*** | (2006.01) |

(52) U.S. Cl.

CPC ..... *H01Q 1/20* (2013.01); *H01Q 1/10* (2013.01); *H01Q 1/50* (2013.01); *H01Q 21/28* (2013.01); *H01Q 1/244* (2013.01)

(58) Field of Classification Search

CPC .. H01Q 1/20; H01Q 1/10; H01Q 1/50; H01Q 1/244; H01Q 21/28; H01Q 1/243; H01Q 1/2266; H01Q 1/36; H01Q 5/335; H01Q 5/50; H01Q 9/42

See application file for complete search history.

(56) References Cited

U.S. PATENT DOCUMENTS

| | | | | |
|---|---|---|---|---|
| 9,484,631 | B1 * | 11/2016 | Napoles | H01Q 5/378 |
| 2007/0080865 | A1 * | 4/2007 | Huang | H01Q 1/243 343/702 |
| 2015/0364825 | A1 * | 12/2015 | Chang | H01Q 9/0421 343/700 MS |

FOREIGN PATENT DOCUMENTS

| | | |
|---|---|---|
| CN | 102569995 A | 7/2012 |
| TW | 201210136 A1 | 3/2012 |

* cited by examiner

*Primary Examiner* — Hoang V Nguyen

(74) *Attorney, Agent, or Firm* — Muncy, Geissler, Olds & Lowe, P.C.

(57) ABSTRACT

An electronic device includes a device body, a processing unit, and an antenna module. The antenna module includes an insulating frame and an antenna structure. The insulating frame has a first surface, and a second surface corresponding to the first surface. The antenna structure includes a feeding portion, a first radiation portion, and a first extension portion. The feeding portion includes a first feeding terminal, a second feeding terminal, and a conductive via. The second feeding terminal is coupled to the processing unit, and the conductive via is configured to connect the first feeding terminal to the second feeding terminal. The first radiation portion is connected to the first feeding terminal, the first extension portion is disposed on the second surface and is connected to the first radiation portion, and a first slot is formed between the first extension portion and the second feeding terminal.

20 Claims, 8 Drawing Sheets

ELECTRONIC DEVICE AND ANTENNA MODULE

CROSS-REFERENCE TO RELATED APPLICATION

This application claims the priority benefit of Taiwan application serial no. 109132589, filed on Sep. 21, 2020. The entirety of the above-mentioned patent application is hereby incorporated by reference herein and made a part of this specification.

BACKGROUND

Technical Field

The present invention relates to an electronic device and an electrical module thereof, and in particular, to an electronic device and an antenna module thereof.

Related Art

In response to the current wireless transmission of a plurality of frequency bands, antennas of consumer electronic products need to cover a wide range of bandwidth. To this end, an antenna design method is to design and synthesize two antennas of a low frequency and a medium high frequency, and add a tuning circuit to the low frequency antenna to switch between different matching circuits, so as to achieve the characteristics of covering the plurality of frequency bands with the low frequency. Such a design method needs to be switched through a connection point of a ground path connected to a switching circuit, which not only has a more complicated design but also has high costs of the antenna that cannot be reduced.

SUMMARY

The present invention provides an electronic device, including an antenna module that can cover a required frequency bandwidth range by using a simple antenna structure in a limited configuration space.

The present invention provides an antenna module, which can cover a required frequency bandwidth range by using a simple antenna structure in a limited configuration space.

The electronic device of the present invention includes a device body, a processing unit, and an antenna module. The processing unit is disposed in the device body. The antenna module is disposed in the device body and includes an insulating frame and an antenna structure. The insulating frame has a first surface and a second surface, where the first surface corresponds to the second surface. The antenna structure includes a feeding portion, a first radiation portion, and a first extension portion, where the feeding portion includes a first feeding terminal, a conductive via, and a second feeding terminal, where the first feeding terminal is disposed on the first surface, the second feeding terminal is disposed on the second surface and is coupled to the processing unit, and the conductive via extends through the insulating frame to connect the first feeding terminal to the second feeding terminal, the first radiation portion is at least partially disposed on the first surface and is connected to the first feeding terminal, the first extension portion is disposed on the second surface and is connected to the first radiation portion, and a first slot is formed between the first extension portion and the second feeding terminal.

The antenna module of the present invention includes an insulating frame and an antenna structure. The insulating frame has a first surface and a second surface. The antenna structure includes a feeding portion, a first radiation portion, and a first extension portion, where the feeding portion includes a first feeding terminal, a conductive via, and a second feeding terminal, where the first feeding terminal is disposed on the first surface, the second feeding terminal is disposed on the second surface and is coupled to the processing unit, and the conductive via extends through the insulating frame to connect the first feeding terminal to the second feeding terminal, the first radiation portion is at least partially disposed on the first surface and is connected to the first feeding terminal, the first extension portion is disposed on the second surface and is connected to the first radiation portion, and a first slot is formed between the first extension portion and the second feeding terminal.

In an embodiment of the present invention, a first opening is formed between the first extension portion and the first radiation portion, and the insulating frame has a first assembling portion and is assembled to a device body by means of the first assembling portion, where the first assembling portion is located within the first opening.

In an embodiment of the present invention, the insulating frame has a third surface connected between the first surface and the second surface, and the first radiation portion extends from the first surface through the third surface to the second surface to be connected to the first extension portion.

In an embodiment of the present invention, the antenna structure includes a second radiation portion and a second extension portion, where the second radiation portion is at least partially disposed on the third surface and is connected to the first radiation portion, and the second extension portion is disposed on the second surface and is connected to the second radiation portion.

In an embodiment of the present invention, a second opening is formed between the second extension portion and the second radiation portion, and the insulating frame has a second assembling portion and is assembled to a device body by means of the second assembling portion, where the second assembling portion is located within the second opening.

In an embodiment of the present invention, the antenna structure includes a third radiation portion and a grounding portion, where the third radiation portion is disposed on the first surface and connects the first feeding terminal to the first radiation portion, the grounding portion is disposed on the first surface and is connected to the first feeding terminal, and a second slot is formed between the third radiation portion and the grounding portion.

In an embodiment of the present invention, the antenna structure includes a grounding portion disposed on the first surface and connected to the first feeding terminal and including two sections that are bent relative to each other, where a third slot is formed between the two sections.

In an embodiment of the present invention, the antenna structure includes a grounding portion disposed on the first surface, where one section of the grounding portion is connected to the first feeding terminal, and a fourth slot is formed between the other section of the grounding portion and the first feeding terminal.

In an embodiment of the present invention, the other section of the grounding portion has at least one protruding portion, where the at least one protruding portion extends from the other section to the first feeding terminal.

In an embodiment of the present invention, the electronic device includes a shielding structure and at least one electronic element, where the at least one electronic element is disposed in the device body, and the shielding structure is disposed in the device body to shield the antenna module from the at least one electronic element.

In an embodiment of the present invention, the antenna structure includes a grounding portion connected to the first feeding terminal and coupled to the shielding structure, so as to be grounded to a ground plane of the electronic device through the shielding structure.

Based on the above, in the antenna module of the present invention, the antenna structure is disposed on a three-dimensional insulating frame, the feeding portion extends from the first surface of the insulating frame to the opposite second surface, the first extension portion extends from the first radiation portion to be located on the second surface, and a first slot is formed between the first extension portion on the second surface and the second feeding terminal. By changing a width of the first slot, impedance matching of the antenna structure in a specific frequency band can be adjusted to cover a required frequency bandwidth range by using a simple antenna structure in a limited configuration space.

In order to make the foregoing features and advantages of the present invention more apparent and easier to understand, the following gives detailed descriptions by listing embodiments with reference to the accompanying drawings.

DETAILED DESCRIPTION OF THE EMBODIMENTS

Figure 1:
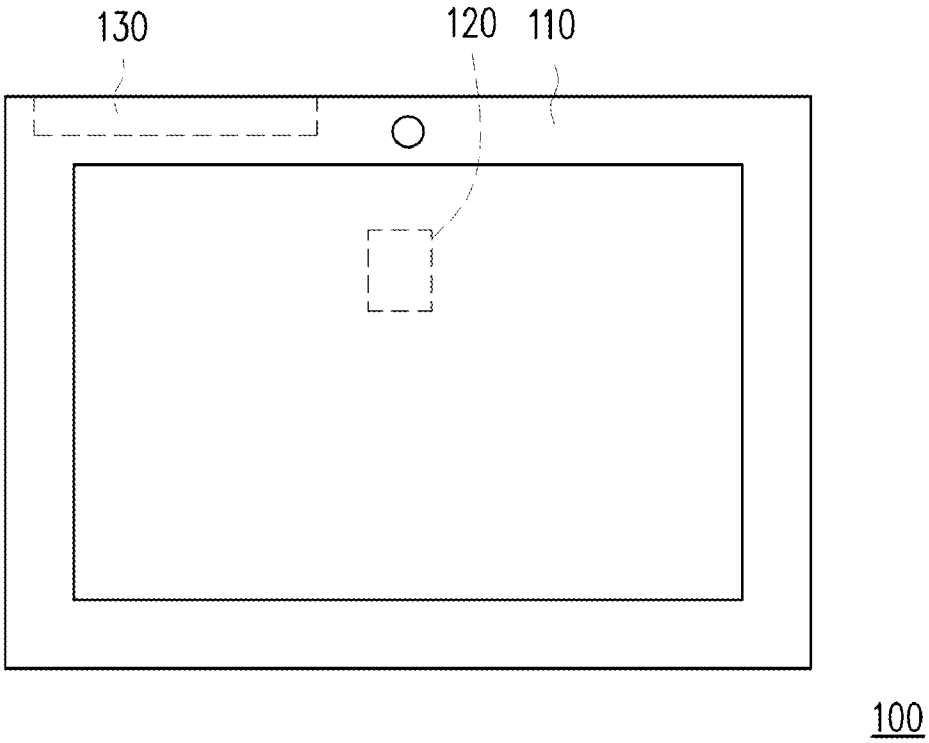
FIG. 1 is a schematic diagram of an electronic device according to an embodiment of the present invention.

FIG. 1 is a schematic diagram of an electronic device according to an embodiment of the present invention. Referring to FIG. 1, an electronic device 100 of this embodiment is a tablet computer and includes a device body 110, a processing unit 120, and an antenna module 130. The processing unit 120 and the antenna module 130 are disposed in the device body 110, the antenna module 130 is coupled to the processing unit 120, and the processing unit 120 is configured to process wireless signals transmitted and received by the antenna module 130. In other embodiments, the electronic device 100 may be other types of electronic products, such as a notebook computer, which is not limited in the present invention.

Figure 2:
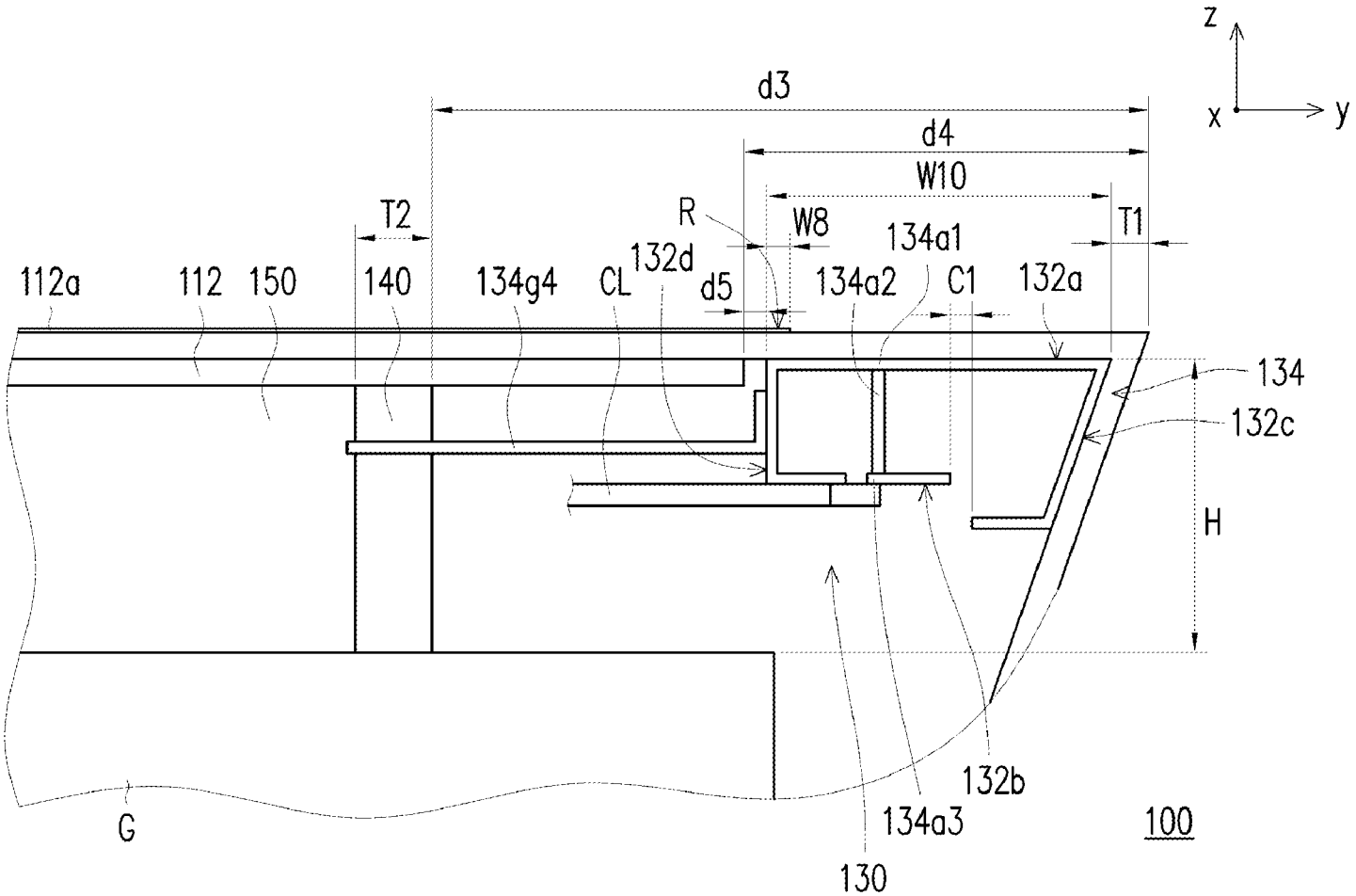
FIG. 2 is a schematic partial cross-sectional view of the electronic device of FIG. 1.
Figure 3:
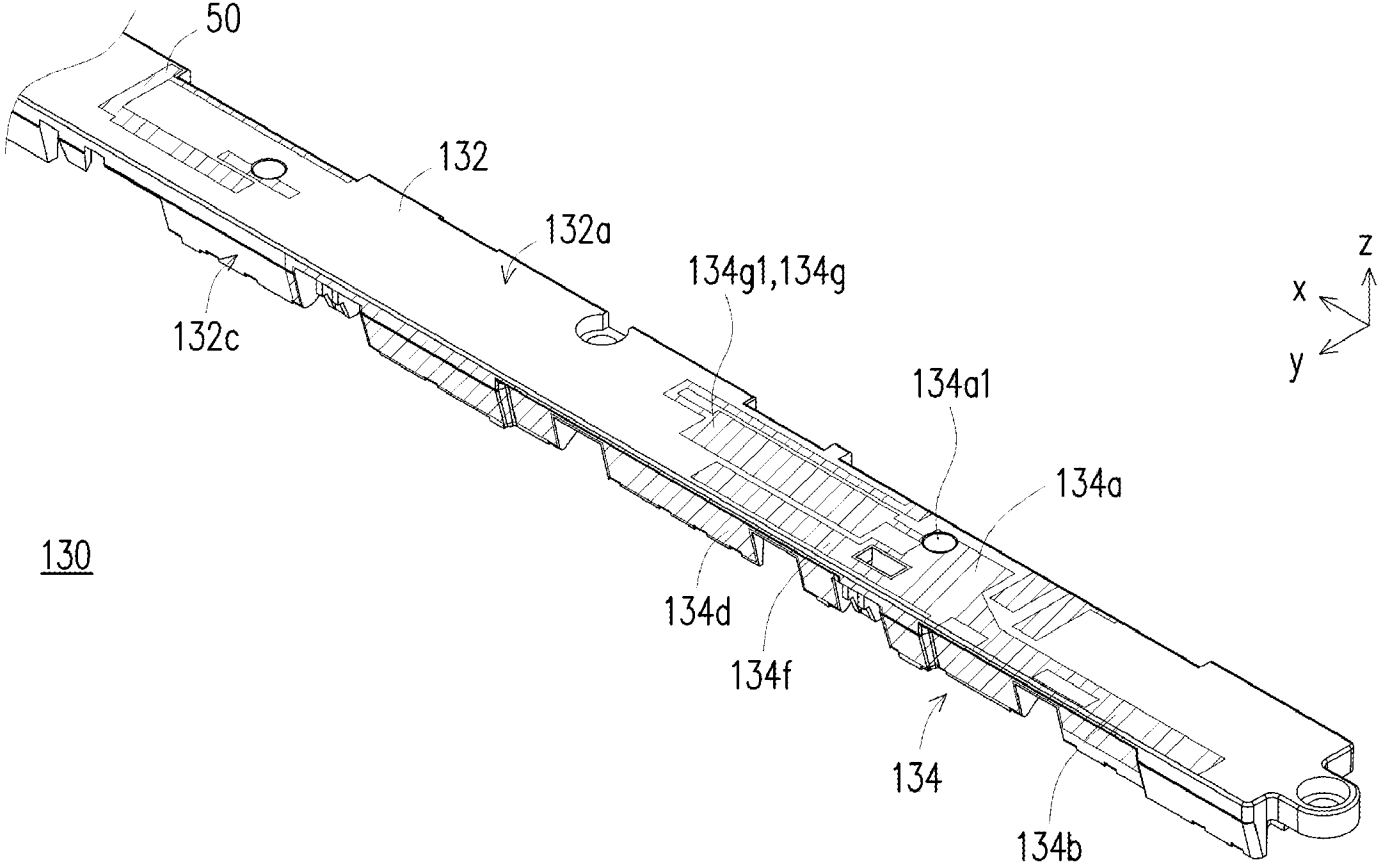
FIG. 3 is a partial three-dimensional view of an antenna module of FIG. 2.

FIG. 2 is a schematic partial cross-sectional view of the electronic device of FIG. 1. FIG. 3 is a partial three-dimensional view of an antenna module of FIG. 2. Referring to FIG. 2 and FIG. 3, the antenna module 130 of this embodiment includes an insulating frame 132 and an antenna structure 134. The insulating frame 132 is made of, for example, plastic, which has a corresponding first surface 132*a* and a second surface 132*b* and has a corresponding third surface 132*c* and a fourth surface 132*d*. The third surface 132*c* is connected between the first surface 132*a* and the second surface 132*b*, and the fourth surface 132*d* is connected between the first surface 132*a* and the second surface 132*b*. The antenna structure 134 is made of metal and is arranged along the first surface 132*a*, the second surface 132*b*, the third surface 132*c*, and the fourth surface 132*d*, for example, by using a laser direct structuring (LDS) process.

Figure 4:
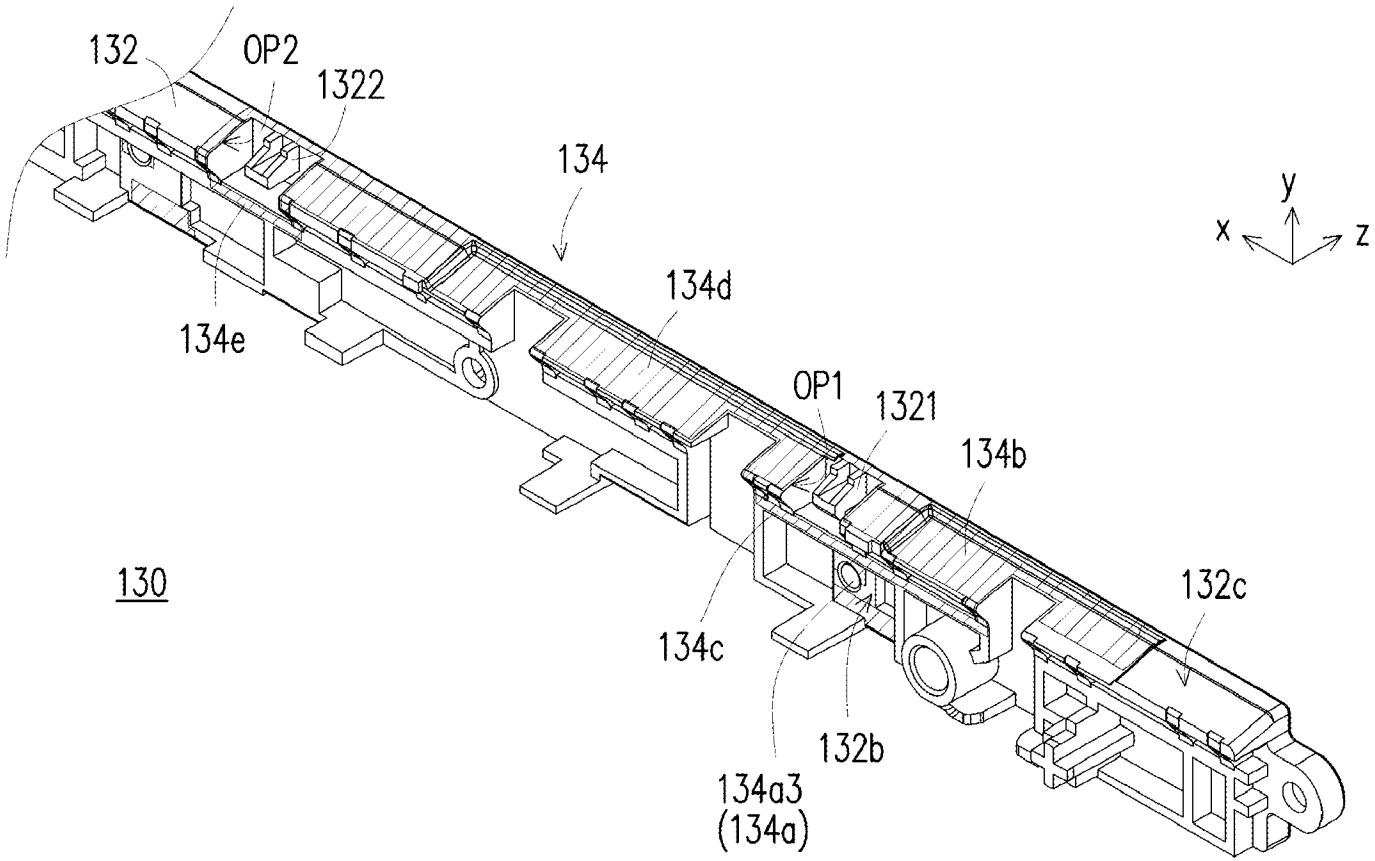
FIG. 4 is a three-dimensional view of the antenna module of FIG. 3 from another perspective.

FIG. 4 is a three-dimensional view of the antenna module of FIG. 3 from another perspective. FIG. 5A to FIG. 5D are each a front view of an antenna structure of FIG. 3 from different perspectives. Referring to FIG. 3 to FIG. 5D, specifically, the antenna structure 134 includes a feeding portion 134*a*, a first radiation portion 134*b*, and a first extension portion 134*c*. The feeding portion 134*a* includes a first feeding terminal 134*a*1, a conductive via 134*a*2, and a second feeding terminal 134*a*3. The first feeding terminal 134*a*1 is disposed on the first surface 132*a* of the insulating frame 132, the second feeding terminal 134*a*3 is disposed on the second surface 132*b* of the insulating frame 132 and is coupled to the processing unit 120 (shown in FIG. 1) through a signal line CL (shown in FIG. 2), and the conductive via 134*a*2 extends through the insulating frame 132 and is connected to the first feeding terminal 134*a*1 and the second feeding terminal 134*a*3. The first radiation portion 134*b* is disposed on the first surface 132*a* of the insulating frame 132 and is connected to the first feeding terminal 134*a*1, and the first radiation portion 134*b* extends from the first surface 132*a* through the third surface 132*c* to the second surface 132*b*. The first extending portion 134*c* is disposed on the second surface 132*b* of the insulating frame 132 and is connected to the first radiation portion 134*b*.

Based on the above, the antenna structure 134 is disposed on a three-dimensional insulating frame 132, the feeding portion 134*a* extends from the first surface 132*a* of the insulating frame 132 to the opposite second surface 132*b*, the first extension portion 134*c* extends from the first radiation portion 134*b* to be located on the second surface 132*b*. Thus, a first slot C1 (marked in FIG. 5D) may be formed between the first extension portion 134*c* and the second feeding terminal 134*a*3, and a corresponding impedance matching bandwidth can be adjusted by changing a width of the first slot C1.

The antenna structure 134 of this embodiment further includes a second radiation portion 134*d* and a second extension portion 134*e*. The second radiation portion 134*d* is disposed on the third surface 132*c* of the insulating frame 132 and is connected to the first radiation portion 134*b*, and the second extension portion 134*e* is disposed on the second surface 132*b* of the insulating frame 132 and is connected to the second radiation portion 134*d*. In addition, the antenna structure 134, for example, generates a low frequency band (for example, 800 MHz) and a corresponding double frequency band (for example, 1700 MHz) by a resonance of the first radiation portion 134*b*, the first extension portion 134*c*, the second radiation portion 134*d*, and the second extension portion 134*e*. By changing a width W1 (marked in FIG. 5D) of the first slot C1, impedance matching of the antenna structure 134 in the low frequency band may be adjusted to cover the required low frequency bandwidth range. Moreover, a resonance frequency of the low frequency band can be adjusted by changing the extension length of the second radiation portion 134*d*.

Further, the antenna structure 134 of this embodiment further includes a third radiation portion 134*f* and a grounding portion 134*g*. The third radiation portion 134*f* is disposed on the first surface 132*a* of the insulating frame 132 and is connected to the first feeding terminal 134*a*1 and the first radiation portion 134*b*, the grounding portion 134*g* is disposed on the first surface 132*a* of the insulating frame 132 and is connected to the first feeding terminal 134*a*1, and a second slot C2 (marked in FIG. 5B) is formed between the third radiation portion 134*f* and the grounding portion 134*g*. By changing a width W2 (marked in FIG. 5B) of the second slot C2, impedance matching of the antenna structure 134 in the low frequency band may also be adjusted to cover the required low frequency bandwidth range.

In addition, the antenna structure 134 generates a first high frequency band (for example, 1600 MHz) and a corresponding double frequency band (for example, 3500 MHz) by a resonance of the first radiation portion 134*b* and the first extension portion 134*c*, and for example, generates a second high frequency band (for example, 2000 MHz) and a corresponding double frequency band (for example, 3700 MHz) by a resonance of the third radiation portion 134*f* Based on the above, the grounding portion 134*g* of this embodiment includes a plurality of sections 134*g*1, 134*g*2, and 134*g*3. The section 134*g*1 is connected to the first feeding terminal 134*a*1, the section 134*g*2 is connected to the section 134*g*1 and is bent relative to the section 134*g*1, and the section 134*g*3 is connected to the section 134*g*2. A third slot C3 (marked in FIG. 5B) is formed between the section 134*g*1 and the section 134*g*2, and a fourth slot C4 (marked in FIG. 5B) is formed between the section 134*g*3 and the first feeding terminal 134*a*1. By changing a width W3 (marked in FIG. 5B) of the third slot C3 and/or a width W4 (marked in FIG. 5B) of the fourth slot C4, impedance matching of the antenna structure 134 in the first and second frequency bands may be adjusted to cover the required high frequency bandwidth range. Moreover, by changing the extension length of the first radiation portion 134*b*, an impedance matching bandwidth and a resonance frequency of the first high-frequency band can be adjusted, and by changing the extension length of the third radiation portion 134*f*, an impedance matching bandwidth and a resonance frequency of the second high frequency band can be adjusted.

Furthermore, the section 134*g*3 of the grounding portion 134*g* of this embodiment has two protruding portions P1, P2, and the protruding portions P1, P2 extend from the section 134*g* to the first feeding terminal 134*a*1. The antenna structure 134, for example, generates a third high frequency band (for example, 5000 MHz) by a resonance of an open loop formed by the protruding portion P1 and the first feeding terminal 134*a*1. By changing the width W5 (marked in FIG. 5B) of the feeding portion 134*a* and a length L1 of the protruding portion P1, distances d1 and d2 between the protruding portion P1 and the first feeding terminal 134*a*1 can be changed, so as to adjust the impedance matching bandwidth and the resonance frequency of the third high frequency band. In addition, by changing a length L2 of the protruding portion P2, the impedance matching bandwidth and the resonance frequency of the corresponding high frequency band (for example, 3800 MHz) can be adjusted.

The antenna module 130 of this embodiment can be applicable to antenna signal processing units of various specifications due to being capable of covering a plurality of frequency bands such as a low frequency band and a high frequency band as described above. Therefore, a signal transmission/reception frequency band can be upgraded or changed as long as a different antenna signal processing unit is replaced, without the need to redesign or replace the antenna module 130, thereby saving device costs.

Figure 5A:
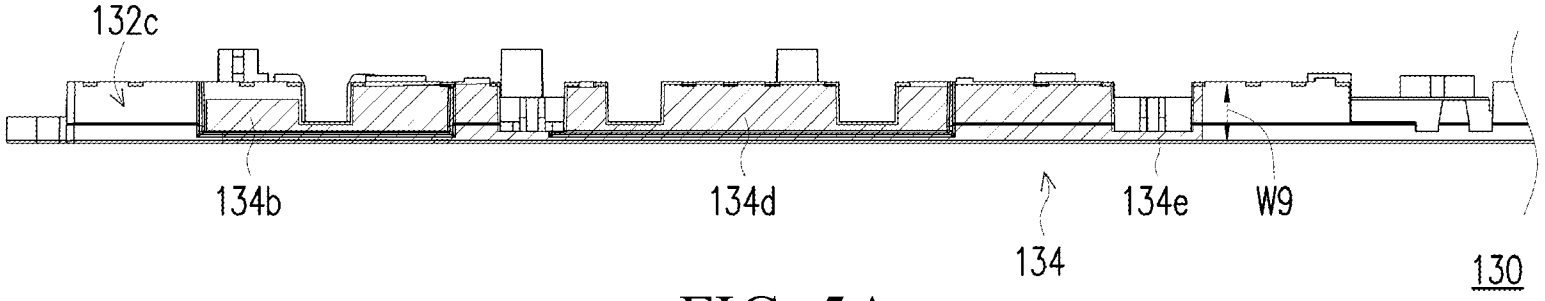
FIG. 5A to FIG. 5D are each a front view of an antenna structure of FIG. 3 from different perspectives.
Figure 5B:
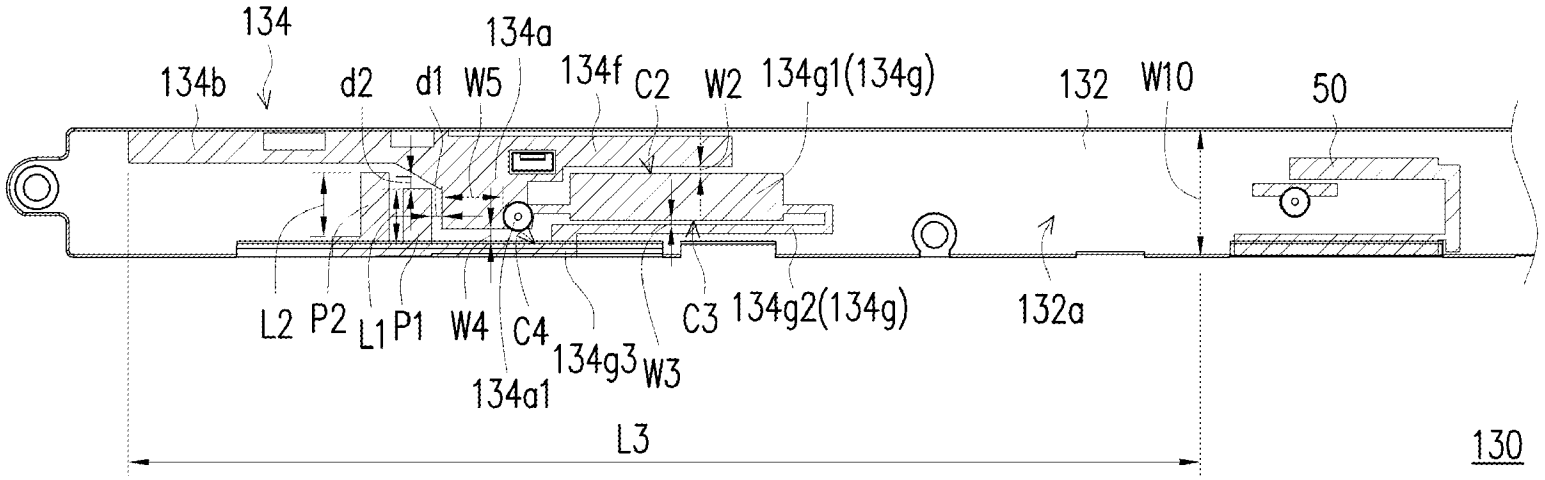
Figure 5C:
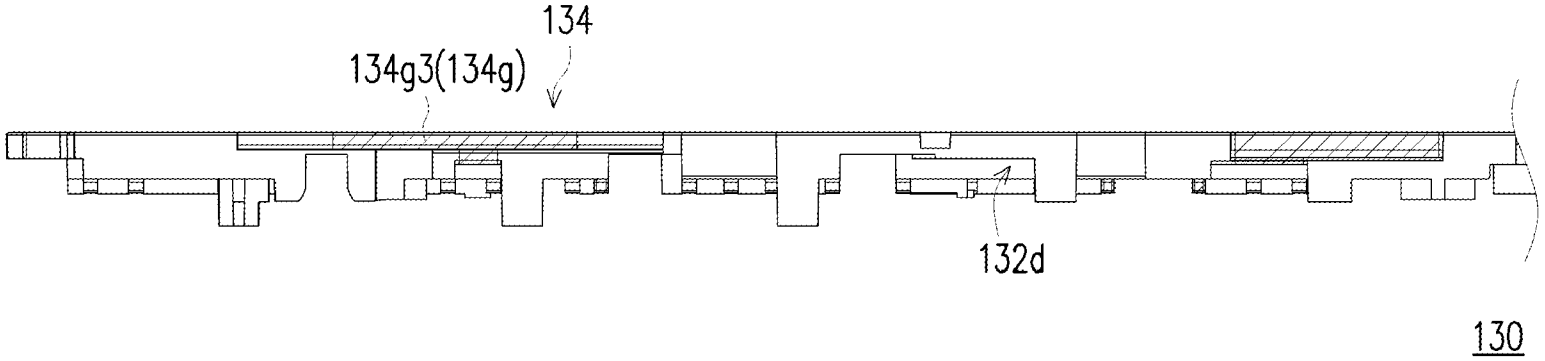
Figure 5D:
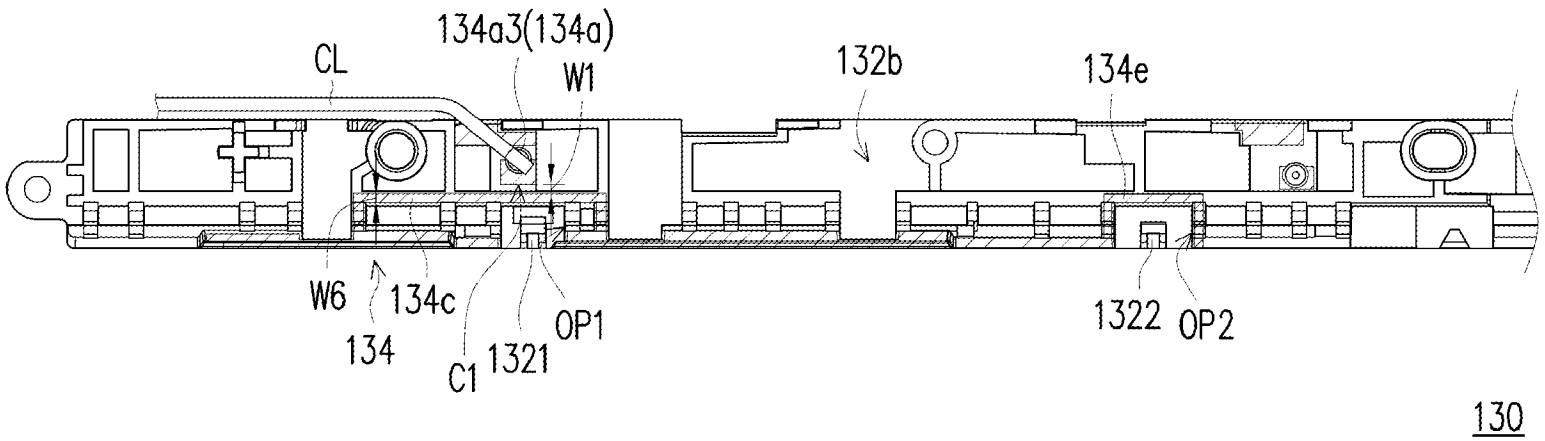

Referring to FIG. 4 and FIG. 5D, the insulating frame 132 of this embodiment has a first assembling portion 1321 and a second assembling portion 1322, and is assembled to the device body 110 by means of the first assembling portion 1321 and the second assembling portion 1322 (shown in FIG. 1 and FIG. 2). Correspondingly, in the antenna structure 134 of this embodiment, the first extension portion 134*c* has a smaller width W6 (marked in FIG. 5D, for example, 1 mm), and a first opening OP1 is formed between the first extension portion 134*c* and the first radiation portion 134*b*. Similarly, the second extension portion 134*e* has a smaller width W7 (marked in FIG. 5D, for example, 1 mm), and a second opening OP2 is formed between the second extension portion 134*e* and the second radiation portion 134*d*. The first assembling portion 1321 and the second assembling portion 1322 are respectively located within the first opening OP1 and the second opening OP2. In this way, the antenna structure 134, the first assembling portion 1321, and the second assembling portion 1322 may be properly arranged in a limited space. The first assembling portion 1321 and/or the second assembling portion 132 are, for example, assembled with a housing of the device body 110 or other components (such as buttons), which is not limited in the present invention.

Referring to FIG. 2, the electronic device 100 of this embodiment further includes a shielding structure 140 and an electronic element 150. The electronic element 150 is disposed within the device body 110, and is, for example, a central processing unit or other elements that may generate interference signals. The shielding structure 140 made of metal is disposed in the device body 110 and shields the antenna module 130 from the electronic element 150, so as to prevent the interference signal generated by the electronic element 150 from causing adverse effects on the antenna module 130. In an embodiment of the present invention, the shielding structure 140 is a conductive foam. In this embodiment, a touch display panel 112 of the device body 110 is grounded through the shielding structure 140, for example, which is grounded to a ground plane G of the electronic device 100. In addition, in the antenna structure 134 of this embodiment, the grounding portion 134*g* extends to the fourth surface 132*d* and is coupled to the shielding structure 140 by means of a copper foil 134*g*4, so as to be grounded to the ground plane G through the shielding structure 140.

In addition, since the antenna module 130 of this embodiment faces the touch display panel 112 with the fourth surface 132*d* (shown in FIG. 2), a side of the antenna module 130 close to the touch display panel 112 is an area where the grounding portion 134*g* is located and is relatively unrelated to antenna radiation efficiency. Therefore, in the area, the antenna structure 134 may be disposed to partially overlap a touch sensing circuit 112*a* of the touch display panel 112 (as shown in an overlapping area R, a width W8 is 0.4 mm, for example) to save the configuration space.

In this embodiment, a width W9 of the insulating frame 132 on the third surface 132*c* (marked in FIG. 5A) is, for example, 4.3 mm, a width W10 of the insulating frame 132 on the first surface 132*a* (marked in FIG. 2 and FIG. 5B) is, for example, 9 mm, and a maximum length L3 (marked in FIG. 5B) of the antenna structure 134 is, for example, 75 mm. In addition, referring to FIG. 2, in this embodiment, a distance d3 between the shielding structure 140 and an edge of the device body 110 is, for example, 17 mm, a distance d4 between the touch display panel 112 and the edge of the device body 110 is, for example, 11.3 mm, a distance d5 between the touch display panel 112 and the antenna module 130 is, for example, 0.8 mm, a thickness T1 of the housing at the edge of the device body 110 is, for example, 1.5 mm, a height H of an internal accommodation space of the device body 110 is, for example, 5.1 mm, and a thickness T2 of the shielding structure 140 is, for example, 3 mm. In other embodiments, the above sizes may be other appropriate values, which is not limited in the present invention.

Figure 6A:
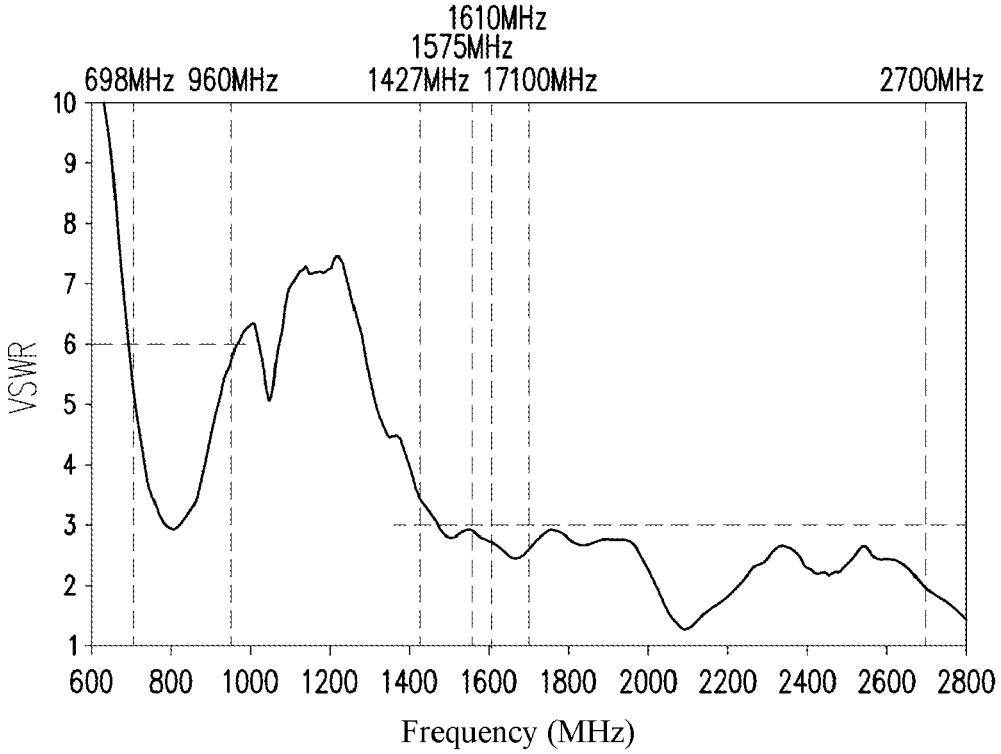
FIG. 6A and FIG. 6B respectively illustrate a voltage standing wave ratio (VSWR) of the antenna module of this embodiment in different frequency bands.
Figure 6B:
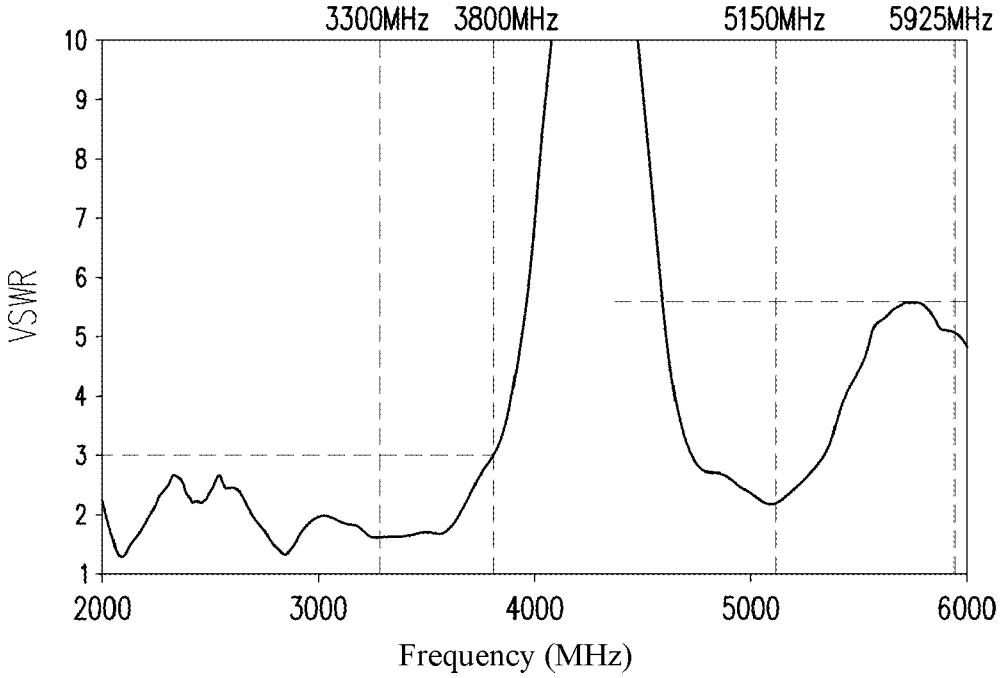

FIG. 6A and FIG. 6B respectively illustrate a voltage standing wave ratio (VSWR) of the antenna module of this embodiment in different frequency bands. As shown in FIG. 6A and FIG. 6B, the VSWR of the antenna module 130 (marked in FIG. 3) of this embodiment in a frequency band of 698 to 960 MHz may be less than or equal to 6, the VSWR in a frequency band of 1427 to 2700 MHz and a 5G frequency band of 3300 to 3800 MHz may be less than 3, and the VSWR in the frequency band of 5150 to 5925 MHz may be less than 5.5. In addition, if the antenna structure 134 is spaced apart from another antenna 50 (for example, a Wi-Fi antenna) shown in FIG. 3 and FIG. 4 by a distance of 3 mm, isolation between the two antennas may be greater than −10 dB.

Figure 7A:
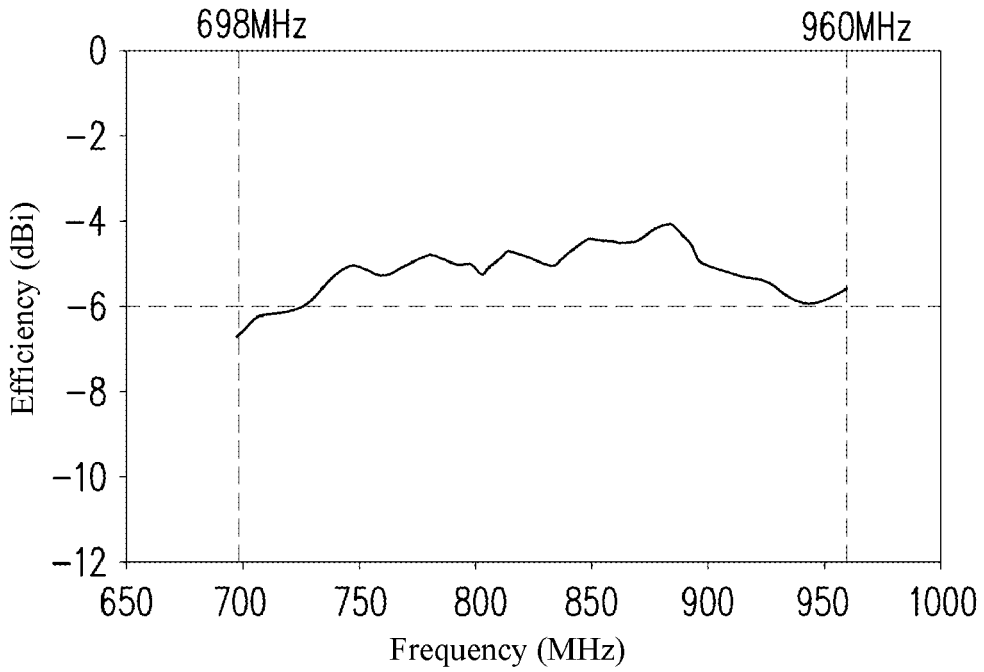
FIG. 7A and FIG. 7B respectively illustrate antenna efficiency of the antenna module of this embodiment in different frequency bands.
Figure 7B:
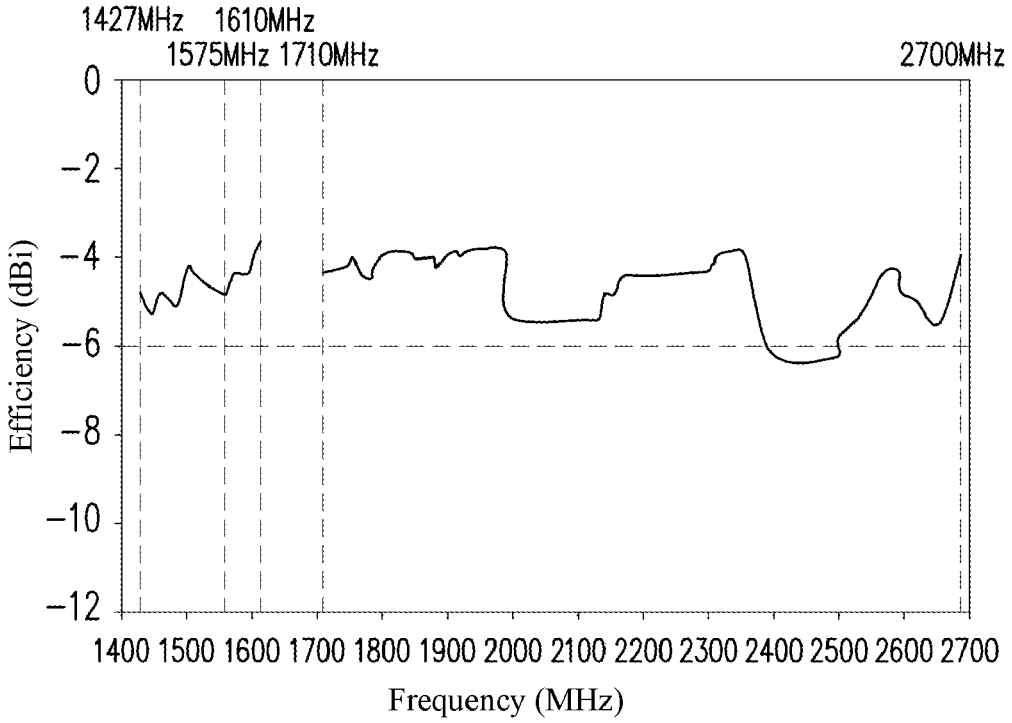

FIG. 7A and FIG. 7B respectively illustrate antenna efficiency of the antenna module of this embodiment in different frequency bands. As shown in FIG. 7A and FIG. 7B, antenna efficiency of the antenna module 130 (marked in FIG. 3) of this embodiment in the frequency band of 698 to 960 MHz may be in a range of −4.0 to −7.3 dBi, the antenna efficiency in the frequency band of 1427 to 1610 MHz may be in a range of −4.3 to −5.9 dBi, the antenna efficiency in the frequency band of 1710 to 2700 MHz may be in a range of −3.2 to −5.4 dBi, the antenna efficiency in the frequency band of 3300 to 3800 MHz may be in a range of −4.1 to −6.1 dBi, the antenna efficiency in the frequency band of 5150 to 5925 MHz may be in a range of −4.2 to −6.4 dBi.

Based on the above, in the present invention, the antenna structure is disposed on the insulating frame to form a three-dimensional structure, and a plurality of slots are formed by using the feeding portion, the radiation portion, and the grounding portion, so that the impedance matching of various frequency bands of the antenna module can be adjusted by changing the widths of the slots. Accordingly, a plurality of required frequency bandwidth range can be covered by using a simple antenna structure in a limited configuration space. In addition, the antenna module of the present invention can be applicable to antenna signal processing units of various specifications due to being capable of covering a plurality of frequency bands such as a low frequency band and a high frequency band. Therefore, a signal transmission/reception frequency band can be upgraded or changed as long as a different antenna signal processing unit is replaced, without the need to redesign or replace the antenna module, thereby saving device costs.

What is claimed is:

1. An electronic device, comprising:

a device body;

a processing unit disposed in the device body; and an antenna module disposed in the device body and comprising:

an insulating frame having a first surface and a second surface, wherein the first surface corresponds to the second surface; and an antenna structure comprising a feeding portion, a first radiation portion, and a first extension portion, wherein the feeding portion comprises a first feeding terminal, a conductive via, and a second feeding terminal, wherein the first feeding terminal is disposed on the first surface, the second feeding terminal is disposed on the second surface and is coupled to the processing unit, and the conductive via extends through the insulating frame to connect the first feeding terminal to the second feeding terminal, the first radiation portion is at least partially disposed on the first surface and is connected to the first feeding terminal, the first extension portion is disposed on the second surface and is connected to the first radiation portion, and a first slot is formed between the first extension portion and the second feeding terminal.

2. The electronic device according to claim 1, wherein a first opening is formed between the first extension portion and the first radiation portion, and the insulating frame has a first assembling portion and is assembled to the device body by means of the first assembling portion, wherein the first assembling portion is located within the first opening.

3. The electronic device according to claim 1, wherein the insulating frame has a third surface connected between the first surface and the second surface, and the first radiation portion extends from the first surface through the third surface to the second surface to be connected to the first extension portion.

4. The electronic device according to claim 3, wherein the antenna structure comprises a second radiation portion and a second extension portion, wherein the second radiation portion is at least partially disposed on the third surface and is connected to the first radiation portion, and the second extension portion is disposed on the second surface and is connected to the second radiation portion.

5. The electronic device according to claim 4, wherein a second opening is formed between the second extension portion and the second radiation portion, and the insulating frame has a second assembling portion and is assembled to the device body by means of the second assembling portion, wherein the second assembling portion is located within the second opening.

6. The electronic device according to claim 1, wherein the antenna structure comprises a third radiation portion and a grounding portion, wherein the third radiation portion is disposed on the first surface and is connected to the first feeding terminal and the first radiation portion, the grounding portion is disposed on the first surface and is connected to the first feeding terminal, and a second slot is formed between the third radiation portion and the grounding portion.

7. The electronic device according to claim 1, wherein the antenna structure comprises a grounding portion disposed on the first surface and connected to the first feeding terminal and comprising two sections that are bent relative to each other, wherein a third slot is formed between the two sections.

8. The electronic device according to claim 1, wherein the antenna structure comprises a grounding portion disposed on the first surface, wherein one section of the grounding portion is connected to the first feeding terminal, and a fourth slot is formed between the other section of the grounding portion and the first feeding terminal.

9. The electronic device according to claim 8, wherein the other section of the grounding portion has at least one protruding portion, wherein the at least one protruding portion extends from the other section to the first feeding terminal.

10. The electronic device according to claim 1, comprising a shielding structure and at least one electronic element, wherein the at least one electronic element is disposed in the device body, and the shielding structure is disposed in the device body to shield the antenna module from the at least one electronic element.

11. The electronic device according to claim 10, wherein the antenna structure comprises a grounding portion connected to the first feeding terminal and coupled to the shielding structure to be grounded to a ground plane of the electronic device through the shielding structure.

12. An antenna module, comprising:

an insulating frame having a first surface and a second surface, wherein the first surface corresponds to the second surface; and an antenna structure comprising a feeding portion, a first radiation portion, and a first extension portion, wherein the feeding portion comprises a first feeding terminal, a conductive via, and a second feeding terminal, wherein the first feeding terminal is disposed on the first surface, the second feeding terminal is disposed on the second surface, and the conductive via extends through the insulating frame to connect the first feeding terminal to the second feeding terminal, the first radiation portion is at least partially disposed on the first surface and is connected to the first feeding terminal, the first extension portion is disposed on the second surface and is connected to the first radiation portion, and a first slot is formed between the first extension portion and the second feeding terminal.

13. The antenna module according to claim 12, wherein a first opening is formed between the first extension portion and the first radiation portion, and the insulating frame has a first assembling portion and is assembled to a device body by means of the first assembling portion, wherein the first assembling portion is located within the first opening.

14. The antenna module according to claim 12, wherein the insulating frame has a third surface connected between the first surface and the second surface, and the first radiation portion extends from the first surface through the third surface to the second surface to be connected to the first extension portion.

15. The antenna module according to claim 14, wherein the antenna structure comprises a second radiation portion and a second extension portion, wherein the second radiation portion is at least partially disposed on the third surface and is connected to the first radiation portion, and the second extension portion is disposed on the second surface and is connected to the second radiation portion.

16. The antenna module according to claim 15, wherein a second opening is formed between the second extension portion and the second radiation portion, and the insulating frame has a second assembling portion and is assembled to a device body by means of the second assembling portion, wherein the second assembling portion is located within the second opening.

17. The antenna module according to claim 12, wherein the antenna structure comprises a third radiation portion and a grounding portion, wherein the third radiation portion is disposed on the first surface and is connected to the first feeding terminal and the first radiation portion, the grounding portion is disposed on the first surface and is connected to the first feeding terminal, and a second slot is formed between the third radiation portion and the grounding portion.

18. The antenna module according to claim 12, wherein the antenna structure comprises a grounding portion disposed on the first surface and connected to the first feeding terminal and comprising two sections that are bent relative to each other, wherein a third slot is formed between the two sections.

19. The antenna module according to claim 12, wherein the antenna structure comprises a grounding portion disposed on the first surface, wherein one section of the grounding portion is connected to the first feeding terminal, and a fourth slot is formed between the other section of the grounding portion and the first feeding terminal.

20. The antenna module according to claim 19, wherein the other section of the grounding portion has at least one protruding portion, wherein the at least one protruding portion extends from the other section to the first feeding terminal.

* * * * *